United States Patent [19]

Levine

[11] Patent Number: 4,531,242

[45] Date of Patent: Jul. 30, 1985

[54] ELASTIC BODYBAND METHOD AND APPARATUS

[76] Inventor: Norman D. Levine, 2205 NW. 30th Pl., Pompano Beach, Fla. 33060

[21] Appl. No.: 474,088

[22] Filed: Mar. 10, 1983

Related U.S. Application Data

[63] Continuation-in-part of Ser. No. 183,195, Sep. 20, 1980, abandoned.

[51] Int. Cl.[3] ..... A41H 1/00

[52] U.S. Cl. ..... 2/243 R; 2/16; 2/170

[58] Field of Search ..... 2/170, 16, 22, 243 R, 2/243 B; 428/250, 246, 261; 156/562, 560, 559; 128/165

[56] References Cited

U.S. PATENT DOCUMENTS

| | | | |
|---|---|---|---|
| 2,127,926 | 8/1938 | Mason | 2/170 |
| 3,092,110 | 6/1963 | Duensing | 128/165 X |
| 3,189,919 | 6/1965 | Chase | 2/16 |
| 3,256,882 | 6/1966 | Huber | 2/16 X |
| 4,014,327 | 3/1977 | Spiro | 128/165 |
| 4,061,256 | 12/1977 | Beer et al. | 2/170 X |
| 4,068,318 | 1/1978 | McMahon | 2/170 |
| 4,120,052 | 10/1978 | Butler | 2/16 |

*Primary Examiner*—Peter Nerbun

*Attorney, Agent, or Firm*—Eugene F. Malin

[57] ABSTRACT

A new and improved method and apparatus for manufacturing an elastic bodyband and the resultant bodyband. One embodiment of the method comprises spreading a piece of terry cloth on a table with the coarse side up, spraying a light coat of adhesive on a piece of Masonite, picking up the smoothed first piece of terry cloth coarse side up with the adhesive side of the Masonite, placing a piece of neoprene of equal length to the terry cloth on the table, spraying a double coat of adhesive on the exposed surface of the smooth side of the first piece of terry cloth, picking up the piece of neoprene with the double coat of adhesive on the exposed surface of the smooth side of the first piece of terry cloth, spreading a second piece of terry cloth on the table with the smooth side up, spraying a double coat of adhesive on the exposed surface of the smooth side of the second piece of terry cloth, pressing and bonding the remaining exposed surface of neoprene to the smooth side of the second piece of terry cloth, and removing the piece of Masonite from the piece of terry cloth, and connecting the opposite ends of the newly formed three-layer length of material to form a bodyband. The preferred method and apparatus eliminate the first light, spraying of adhesive. The bodyband when placed about a body portion is used to both warm the covered body area and absorb excess perspiration.

9 Claims, 6 Drawing Figures

ELASTIC BODYBAND METHOD AND APPARATUS

BACKGROUND OF THE INVENTION

This is a continuation-in-part of application Ser. No. 06/183,195 originally filed Sept. 20, 1980, now abandoned.

This invention relates to elastic body wrap particularly to a new and improved body support. In the past there have been various devices used to wrap around the wrist for various purposes. By way of example is U.S. Pat. No. 2,638,599, in which a sponge rubber wristlet is shown. This wrist device is designed solely to provide efficient protection of the user's forearm against flow of moisture from the hand or to prevent moisture from the user's hand so that the water and moisture will not come in contact with the forearm. The present invention improves upon the other devices by providing a wrist support which not only absorbs perspiration but also provides maximum support, warmth, and comfort when wrapped around the wrist. The properties of the neoprene make it possible to provide the added support. The present invention also teaches a simple method and apparatus for manufacturing the wrist device that provides warmth and support, which is not indicated in the prior art.

SUMMARY OF THE INVENTION

A new and improved method and apparatus for manufacturing an elastic bodyband and a resultant bodyband. The bodyband comprises an inner layer of stretch terry cloth, a middle layer of closed cell neoprene sponge material, and an outer layer of stretch terry cloth. Additionally any connecting device can be connected to the wristband in order to further tighten the bodyband for desired support.

One method for constructing the new and improved wristband comprises spraying a light coat of adhesive on a piece of MASONITE; pressing and bonding the piece of MASONITE to the inner layer of stretch terry cloth which has been moved onto the work surface with the coarse side facing upward; spraying a double coat of adhesive on the exposed smooth surface of the inner layer of stretch terry cloth, impressing and bonding the smooth surface on the inner layer to a piece of neoprene which has been layed on the working surface; spraying a double coat to adhesive on the exposed surfaces of the neoprene; pressing and bonding the exposed surface of the neoprene to the smooth surface of the outer layer stretch terry cloth which has been smoothed onto the working surface; removing the MASONITE from the inner layer; and connecting the opposite ends of the three-layer piece of and connecting the opposite ends of the three-layer piece of fabric to form the bodyband. The preferred embodiment and apparatus eliminate the first light spraying of adhesive, thus a simpler method. Additionally, since the stretch terry cloth has a directional stretch characteristic, the bodyband can have a strap means added to it for tightening the bodyband about the wrist.

It is therefore an object of this invention to provide a new and improved elastic bodyband which not only absorbs perspiration but provides warmth by retention or absorption, and added support to the body when employed.

It is another object of this invention to provide a new and improved elastic bodyband which has an adjusting strap means thereon which can be used to tighten the elastic bodyband about a body portion of the user.

It is yet another object of this invention to provide a new and improved method for manufacturing a elastic bodyband.

It is still another object of this invention to provide an apparatus for manufacturing a new and improved elastic bodyband.

In accordance with these and other objects which will be apparent hereinafter, the instant invention will now be described with particular reference to the accompanying drawings.

DESCRIPTION OF THE PREFERRED EMBODIMENT

Figure 1:
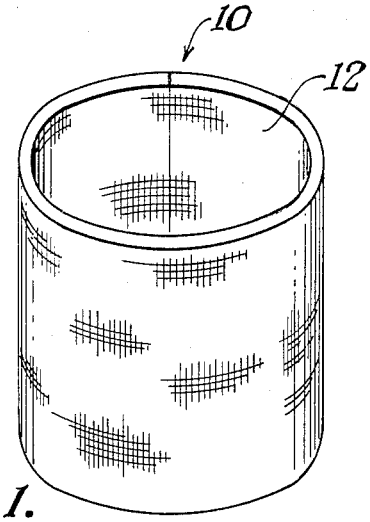
FIG. 1 is an illustration of the bodyband.
Figure 2:
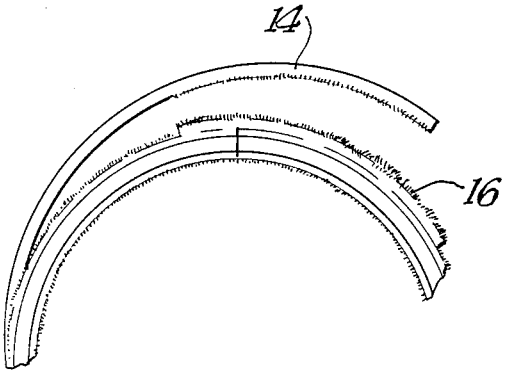
FIG. 2 is a partial side view of the bodyband showing an optional strap to tighten the band when about a users body portion.

Referring to the drawings, and more particularly to FIG. 1, the bodyband is designated generally at 10 and comprises a substantially annular body of three layered piece of fabric having a central aperture 12 adapted to receive a person's body portion, the aperture 12 being somewhat smaller in diameter than the diameter of the person's particular body portion. The body portion is engaged in the aperture 12 when worn, the bodyband being sufficiently tight around the user's body portion to provide support and forming at least a partially sealed connection therewith. However, as the bodyband absorbs perspiration it tends to also warm and stretch and slide along the user's body portion. Therefore, as shown in FIG. 2 an optional and preferred strap, including a first portion 14 and a second portion 16 is included to tighten the bodyband about the body portion of the user. In this embodiment a fabric fastener such as hook and loop connectors is attached to the wrist support and is designated as 16 and the other portion of the strap 14 is made of fabric such as felt which will engage with the hook and loop connector to maintain the wrist support and strap in the desired position. Two separate straps may be used with the connectors described above, preferrably such as a VELCRO connector.

Figure 3:
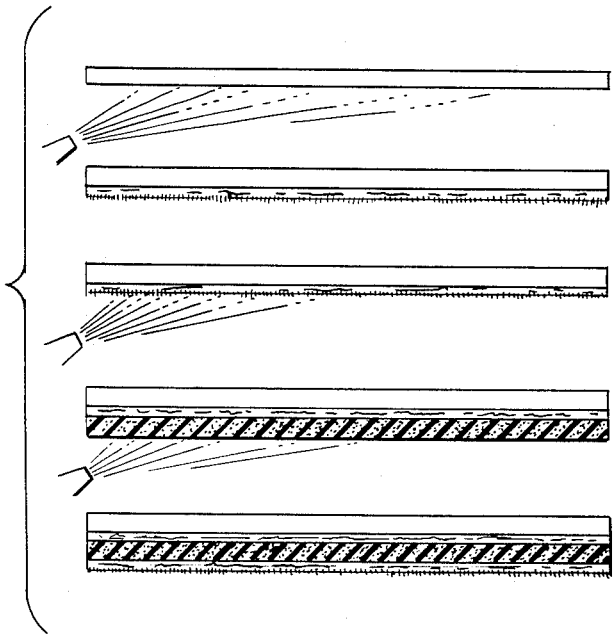
FIG. 3 is an illustration of one method of construction.
Figure 4:
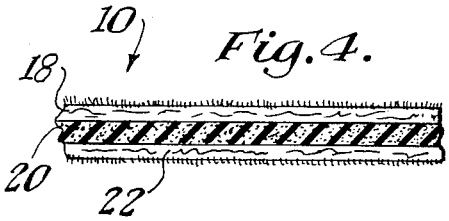
FIG. 4 is a partial cross-section view of the bodyband.

Referring now to FIG. 3 one method of constructing the layered fabric is described. This embodiment of the method of manufacture is as follows: first a light coat of adhesive is sprayed onto a piece of MASONITE; the MASONITE is then pressed onto and bonded to the hooked or coarse side of a piece of terry cloth which has been smoothed onto another working surface with the coarse side facing upward; two coats of adhesive are then sprayed onto the smooth side of the inner or first layer of terry cloth and it is then pressed onto and bonded with a piece of neoprene which has been layed out on a work surface, the nonbonded surface of the neoprene is then again sprayed with a double coat of adhesive before being lowered onto the outer layer of terry cloth which has been previously laid onto a work surface with the smooth side facing upward.

Thus, when the process, shown in FIG. 3, is completed the bodyband 10 comprised of an inner layer 18 of terry cloth with the coarse side facing outwardly, a layer of closed cell neoprene sponge 20, and another terry clothlayer 22 which also has its coarse side facing outwardly. This enables the user to have the inner layer of terry cloth against the skin for comfort and to absorb perspiration for the body portion beneath and the outer layer of terry cloth to wipe other skin areas such as the brow to keep the perspiration from dripping into the eyes.

A very important feature of this invention is made apparent by considering that the body of the user is cooled by the evaporation of perspiration. This evaporation from the same area beneath the bodyband is stopped by the closed cell neoprene sponge layer. The insulating characteristics of the neoprene sponge retain the body heat. Additionally, the bodyband generates a little more heat from friction between the body and the user's skin beneath.

Figure 5:
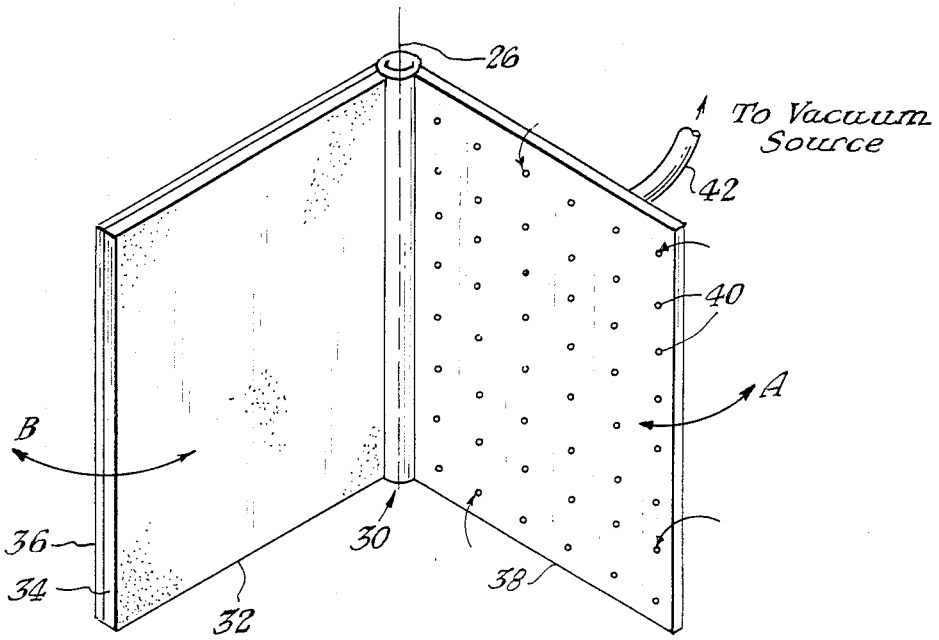
FIG. 5 is an illustration of the apparatus used in manufacturing the bodyband.
Figure 6:
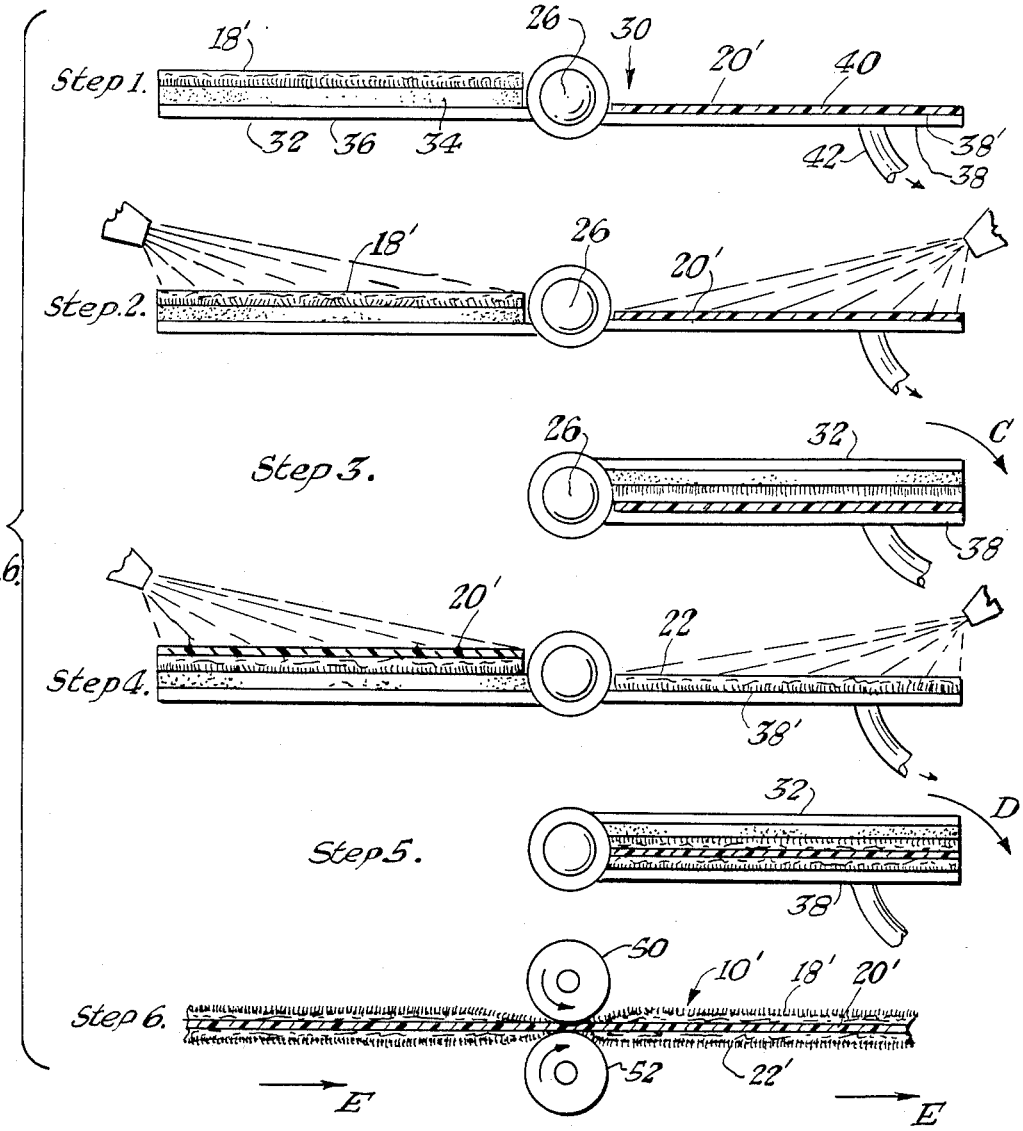
FIG. 6 is an illustration of the preferred method of construction means and the apparatus in FIG. 5.

Referring now to FIGS. 5 and 6 the preferred method and apparatus 30 are shown. The apparatus 30 includes two generally planer members 32 and 38 having a common hinged edge about axis 26 and are pivotable in direction A and B toward and away from coplaner juxaposition. Planer member 32 includes a rigid back plate 36 having a foam rubber or sponge type material 34 connected to its front surface as shown. Planer member 38 is a generally hollow rigid plate having a plurality of apertures 40 over its front surface and a tube or hose 42 interconnector between the back side of planer member 38 and a vacuum source. The hollow space within planer number 38 is airtight except that apertures 40 and tube 42 are in fluid communication with one another.

The usefulness of the above described structure of the apparatus 30 is now described in light of the preferred method of manufacturer as set forth in FIG. 6 and herebelow described. In step 1, a first piece of terry cloth 18' is spread over the foam rubber layer 34 of planer member 32 with the coarse surface of the terry cloth against the foam rubber 34. Because the surface texture of the terry cloth and foam rubber exhibit a clinging effect to one another, the terry cloth may be suitably stretched and flattened thusly onto the foam rubber while a piece of neoprene 20' is placed onto the apertured surface 38' of hollow planer member 38. The vacuum source to the apertures 40 provide a suction-type retention force required to hold the neoprene shut 20' against the planer member 38. In step 2 adhesive is sprayed on at least one and preferrably both exposed layer surfaces of the first terry cloth piece 18' and the neoprene 20'. Planer member 32 in step 3 is then pivoted about axis 26 in direction C to place the two planer members 32 and 38 in juxapositioned co-planer relation and thusly to press and adhere the first terry cloth layer 18' against the neoprene layer 20'. In step 4 the planer members are again opened, the coarse side of a second piece of terry cloth 22' is placed against the suction-providing apertured surface 38' of planer member 38 and held thusly in the desired position after which adhesive is sprayed over at least one and preferrable both second terry cloth piece 22 and the neoprene layer 20'. Then in step 5, the planer member 32 is again pivoted to a closed position against planer member 38 pressing and adhering the second terry cloth layer 22' against the neoprene layer 20'.

Although not required as seen in the method of FIG. 5, the preferred method of FIG. 6 includes step 6 which is to feed the adhered three-layer bodyband through a pair of rollers 50 and 52 which are rotating in the direction of the arrows. The bodyband 10' is moved through the rollers in the direction of arrows E. The rollers 50 and 52 are spaced apart such that the gap between the rubber surfaces is somewhat smaller than the normal, relaxed thickness of the bodyband 10', thus causing compression of the bodyband as it passes between the rubbers. This compression has the effect of further driving the adhesive into the terry cloth fibers, thereby enhancing the strength of the bond between the neoprene layer and the smooth sides of the first and second terry cloth layers. The resultant bonded layers may then be sized if required, and then connected at opposite ends to form a tubular member for use.

The instant invention has been shown and described herein in what is considered to be the most practical and preferred embodiment. It is recognized, however, that departures may be made therefrom within the scope of the invention and that obvious modifications may occur to a person skilled in the art

What I claim is:

1. A method of manufacturing an improved bodyband composite having a first layer of terrycloth having smooth and coarse sides, an intermediate layer of neoprene, and a second layer of terrycloth having a smooth side, said method comprising the steps of:

A. applying at least one layer of adhesive onto one side of said intermediate neoprene layer;

A.(1) applying at least one layer of adhesive onto the smooth side of said first layer of terrycloth;

A(1)(a). spraying at least a light coat of adhesive onto a working surface of a working member;

A(1)(b). pressing and bonding said working surface and said coarse side of said first layer of terrycloth to lift and hold said first layer of terrycloth;

B. pressing and bonding the smooth side of said first layer of terrycloth to said one side of said intermediate neoprene layer;

C. applying at least one layer of adhesive onto the other side of said intermediate neoprene layer; and D. pressing and bonding the smooth side of said second layer of terrycloth to said other side of said intermediate neoprene layer thus forming a three layer piece of fabric of predetermined length.

2. A method as set forth in claim 1, wherein said step C may alternately or collectively include:

C(1). applying at least one layer of adhesive onto the smooth side of said second layer of terry cloth.

3. A method as set forth in claim 2, wherein said adhesive application onto said smooth side of said second layer of terry cloth in said step C(1) comprises the further steps of:

C(1)(a). spraying at least a light coat of adhesive onto a working surface of a working member;

C(1)(b). pressing and bonding said working surface and said coarse side of said second layer of terry cloth together to lift and hold said second layer of terry cloth; and then C(1)(c). applying at least one coat of adhesive onto said smooth side of said second layer of terry cloth.

4. A method as set forth in claim 3, further comprising the step of:

F. connecting a tightening means to said bodyband for increasing retention to, and support of, a body portion.

5. A method as set forth in claim 1 including applying the adhesive onto the smooth side of said first layer of terrycloth subsequent to bonding said working surface to said coarse side of said first layer of terrycloth.

6. A method as set forth in claim 1 further including the step of connecting the opposite ends of said fabric to form a bodyband.

7. A method as set forth in claim 5 further including the step of connecting the opposite ends of said fabric to form a bodyband.

8. A method as set forth in claim 1 wherein the following steps further comprise the steps of:

A(1)(a). spreading the coarse side of said first layer of terry cloth onto a first sponge-covered working surface;

A(1)(b). spreading said intermediate neoprene layer onto a second suction-producing working surface;

A(1)(c). applying at least one coat of adhesive;

B(1). rotating said first and second working surfaces together about the common axis of the interconnecting hinge connected along one edge of each said working surface such that said smooth surface of said first layer of terry cloth comes in contact with said one side of said intermediate neoprene layer;

B(2). said pressing and bonding said smooth side of said first layer of terry cloth to said one side of said intermediate neoprene layer;

B(3). opening said first and second working members by rotating them apart;

C(1)(a). spreading the coarse side of said second layer of terry cloth onto said second suction-producing working surface;

C(1)(b). said applying at least one coat of adhesive;

D(1). rotating said first and second working surface together about the common axis of the interconnecting hinge connected along one edge of each said working surface such that said smooth surface of said second layer of terry cloth comes in contact with said other side of said intermediate neoprene layer;

D(2). said pressing and bonding said smooth side of said second layer of terry cloth to said other side of said intermediate neoprene layer.

9. A method as set forth in claim 8, further comprising the steps of:

F. connecting a tightening means to said bodyband for increasing retention to and support of a body portion.

* * * * *